US006527913B1

(12) United States Patent
Johnson et al.

(10) Patent No.: US 6,527,913 B1
(45) Date of Patent: Mar. 4, 2003

(54) CREPING BLADE, SYSTEM, AND METHOD FOR CREPING A CELLULOSIC WEB

(75) Inventors: Douglas W. Johnson, Appleton, WI (US); Dale T. Gracyalny, Appleton, WI (US)

(73) Assignee: Fort James Corporation, Deerfield, IL (US)

( * ) Notice: Subject to any disclaimer, the term of this patent is extended or adjusted under 35 U.S.C. 154(b) by 7 days.

(21) Appl. No.: 09/684,790

(22) Filed: Oct. 10, 2000

Related U.S. Application Data

(60) Provisional application No. 60/158,024, filed on Oct. 7, 1999.

(51) Int. Cl.[7] ..... B31F 1/14; B31F 1/12; D21G 3/04

(52) U.S. Cl. ..... 162/111; 162/281; 264/283

(58) Field of Search ..... 162/280–281, 162/111, 112, 113, 117, 272; 264/282–284; 156/183; 101/157.169, 369; 118/126, 261, 413; 15/256.5

(56) References Cited

U.S. PATENT DOCUMENTS

| | | | | |
|---|---|---|---|---|
| 1,548,783 | A | | 8/1925 | Lorenz |
| 1,571,593 | A | | 2/1926 | Lorenz |
| 1,582,842 | A | | 4/1926 | Lorenz |
| 1,588,732 | A | | 6/1926 | Hoberg |
| 1,653,434 | A | | 12/1927 | Lorenz |
| 1,702,166 | A | | 2/1929 | Lorenz |
| 2,494,723 | A | | 1/1950 | Rowe |
| 2,874,618 | A | | 2/1959 | Yang |
| 2,995,180 | A | | 8/1961 | Klenk |
| 3,044,228 | A | | 7/1962 | Peterson |
| 3,163,575 | A | | 12/1964 | Nobbe |
| 3,300,368 | A | | 1/1967 | Cooper et al. |
| 3,301,746 | A | | 1/1967 | Sanford et al. |
| 3,507,745 | A | | 4/1970 | Fuerst |
| 4,185,399 | A | | 1/1980 | Gladish |
| 4,304,625 | A | | 12/1981 | Grube et al. |
| 4,488,932 | A | | 12/1984 | Eber et al. |
| 5,164,045 | A | | 11/1992 | Awofeso et al. |
| 5,383,778 | A | | 1/1995 | Schulz |
| 5,409,572 | A | | 4/1995 | Kershaw et al. |
| 5,656,134 | A | | 8/1997 | Marinack et al. |
| 5,685,954 | A | | 11/1997 | Marinack et al. |
| 5,690,788 | A | | 11/1997 | Marinack et al. |
| 5,885,415 | A | | 3/1999 | Marinack et al. |
| 5,885,416 | A | | 3/1999 | Marinack et al. |
| 5,885,417 | A | | 3/1999 | Marinack et al. |
| 5,908,533 | A | | 6/1999 | Marinack et al. |
| 6,027,614 | A | | 2/2000 | Parker et al. |
| 6,042,693 | A | * | 3/2000 | Marinack ..... 162/281 |
| 6,066,234 | A | | 5/2000 | Parker et al. |
| 6,074,526 | A | * | 6/2000 | Marinack ..... 162/111 |
| 6,096,168 | A | * | 8/2000 | Marinack et al. ..... 162/111 |

FOREIGN PATENT DOCUMENTS

| | | |
|---|---|---|
| AU | 322 894 | 10/1976 |
| FR | 2361222 | 3/1978 |
| FR | 2 431 568 | 2/1980 |
| GB | 389832 | 3/1933 |
| GB | 456032 | 11/1936 |
| GB | 827735 | 2/1960 |
| IT | 615517 | 1/1961 |

* cited by examiner

*Primary Examiner*—José A. Fortuna
(74) *Attorney, Agent, or Firm*—Finnegan, Henderson, Farabow, Garrett & Dunner, L.L.P.

(57) ABSTRACT

A creping blade for creping a cellulosic web from a rotatable cylinder in a creping process includes first and second side faces. The first side face is at least substantially opposite to the second side face. The blade also includes an upper surface that is not orthogonal to at least one of the first and second side faces. Also included are a plurality of notches. Each of the notches has a bottom portion and an open end. The bottom portion is at least substantially parallel to the upper surface and the open end is defined by at least a portion of the upper surface. The notches are configured to increase the caliper of the cellulosic web when the creping blade crepes the cellulosic web from an outer surface of the rotatable cylinder. Also provided are systems and methods for creping a cellulosic web and creped paper.

33 Claims, 12 Drawing Sheets

CREPING BLADE, SYSTEM, AND METHOD FOR CREPING A CELLULOSIC WEB

This application relies on the benefit of priority of U.S. provisional patent application Ser. No. 60/158,024, filed Oct. 7, 1999, the entire disclosure of which is incorporation herein by reference.

BACKGROUND OF THE INVENTION

1. Field of the Invention

The present invention relates to creping a cellulosic web from a rotatable cylinder to form paper, such as toilet tissue, facial tissue, and paper toweling, for example. More particularly, the present invention relates to a creping blade and system for creping a cellulosic web from a rotatable cylinder. The present invention also relates to a method of manufacturing paper and paper having substantially constant caliper and strength.

2. Description of Related Art

Paper is generally manufactured by a process that includes dispersing cellulosic fibers (e.g., wood fibers) in a liquid (e.g., solution including water) to form a mixture having the cellulosic fibers suspended in the liquid. A substantial portion of the liquid is then removed from the mixture. As the liquid is removed, the cellulosic fibers begin to link to one another, thereby forming a cellulosic web. The linking of the cellulosic fibers results from mechanical interlocking of the fibers and from hydrogen bonding between the fibers. The hydrogen bonding between the fibers is the predominant linking mechanism.

After removing at least a portion of the liquid from the mixture, the cellulosic web is positioned on a rotatable cylinder, such as a heated Yankee dryer, to remove more of the liquid from the mixture. Depending on the amount of liquid still present, the cellulosic web either is self-adhered to the rotatable cylinder or is positioned on the rotatable cylinder with an adhesive agent configured to allow removal of the web from the cylinder without destroying the web. After the web has been rotated on the cylinder to remove additional moisture, the web is removed from the rotatable cylinder. Thereafter, the web is either wound onto a reel or may be further dried and processed into paper and/or paper products.

The structural integrity and strength of the cellulosic web results from the mechanical and hydrogen bonding between the individual cellulosic fibers. Strength and softness of the paper, however, are inversely proportional to one another. That is, as the strength of the paper increases, the softness of the paper decreases. For paper that is used as bathroom tissue (e.g., toilet tissue or facial tissue), both strength and softness are very important. In particular, consumer preferences demand soft bathroom tissue.

Paper produced by conventional processes, such as the process described above, is generally perceived by consumers as not being soft enough for use as bathroom tissue. One common method of increasing the softness of paper used as bathroom tissue is to crepe the paper. Creping is a procedure that includes scraping the cellulosic web from the rotatable cylinder with a creping blade. Creping the cellulosic web advantageously breaks some of the inter-fiber bonds of the cellulosic web, thereby increasing the softness and decreasing the strength of the paper.

Conventional creping blades generally include an elongated blade having a planar, beveled surface that defines a scraping edge. The blade is generally substantially the same length as the rotatable cylinder. The scraping edge is positioned against the rotatable cylinder to scrape the cellulosic web from the cylinder to break some of the inter-fiber bonds, and thereby increase the softness. Creping also increases the caliper of the cellulosic web. Caliper, as used herein, is a term of art that refers to the thickness or bulk of paper. Convention creping blades, however, suffer from the drawback that the caliper of paper produced by them is still not large enough.

A modified creping blade that produces bathroom tissue having a larger caliper than conventional creping blades, while maintaining a desirable level of strength and softness of the paper, is disclosed in U.S. Pat. No. 5,656,134 (hereafter "the '134 patent"), the entire disclosure of which is incorporated herein by reference. The '134 patent discloses a creping blade (hereafter "the '134 blade") that includes a beveled surface beveled with respect to faces of the blade and serrulations formed in the blade adjacent to the bevel surface. The serrulations are preferably configured so that a bottom of each serrulation is perpendicular to faces of the blade. The serrulations advantageously provide paper having a desired combination of strength, softness, and caliper or thickness, for use as bathroom tissue. See the '134 patent, column 3, line 26 to column 4, line 6.

To crepe a cellulosic web, the '134 blade is positioned on a rotatable cylinder (e.g., Yankee dryer) so that a scraping edge or surface will scrape the cellulosic web from the cylinder when the cylinder rotates with the cellulosic web thereon. The blade is positioned with respect to the cylinder at an angle called a wear or creping angle. The wear or creping angle is defined as an angle having a vertex at the point of contact between the blade and the cylinder and rays defined by a portion of a face of the blade and a portion of a line tangent to the point of contact.

The caliper of the paper produced with the '134 blade is determined in part by an effective depth of the serrulations. The effective depth is defined as the depth of the serrulations measured along the wear angle (i.e., along the direction of a line tangent to the cylinder at the blade contact point). As the blade disclosed in the '134 patent wears, the effective depth of the serrulations changes. When the depth of the serrulations changes, the caliper and strength of the paper produced using the serrulated blade also changes. At a point where the caliper and strength of the paper produced by a blade configured like the '134 blade is no longer within acceptable manufacturing tolerances because of the changing effective serrulation depth, the creping blade must be replaced.

The amount of production time during which a creping blade will produce saleable paper (i.e., paper having a caliper and strength within manufacturing tolerances) before being replaced is referred to as the useful life of the blade. The actual useful life of a blade depends upon a number of factors, such as the material in the cellulosic web. For example, recycled material, such as material including ash, tends to wear creping blades faster than other types of materials.

It is advantageous to have a creping blade with a relatively long useful life because creping blade replacement is extremely costly. In particular, the entire production line must be shut down every time the creping blade is replaced and during this shut down time no saleable paper can be produced. In addition, creping blades are relatively expensive to produce.

In light of the foregoing, there is a need in the art for an improved creping blade, an improved system for creping a cellulosic web, and an improved method for creping a cellulosic web.

SUMMARY OF THE INVENTION

Accordingly, the present invention is directed to a creping blade, a system for creping a cellulosic web, and a method of manufacturing paper that obviate one or more of the shortcomings of the related art. To achieve these and other advantages, and in accordance with the purpose of the invention, as embodied and broadly described herein, the invention includes a creping blade for creping a cellulosic web from a rotatable cylinder in a creping process. The creping blade includes first and second side faces. The first side face is at least substantially opposite to the second side face. The blade also includes an upper surface that is not orthogonal to at least one of the first and second side faces. Also included are a plurality of notches. Each of the notches has a bottom portion and an open end. The bottom portion is at least substantially parallel to the upper surface and the open end is defined by at least a portion of the upper surface. The notches are configured to increase the caliper of the cellulosic web when the creping blade crepes the cellulosic web from an outer surface of the rotatable cylinder.

In an aspect, the upper surface is planar.

In another aspect, an effective notch depth of each notch, which is defined by the distance between the bottom portion and the open end in a direction along a wear angle of the creping blade, remains substantially constant when contact between the creping blade and the rotatable cylinder wears the creping blade. Preferably, the caliper and strength of the cellulosic web creped by the creping blade are substantially unaffected by wear of the creping blade.

In yet another aspect, the notches are configured so that the bottom portion of each of the notches is at least substantially in a plane that is at least substantially parallel to the upper surface.

In still another aspect, the bottom portion of at least one of the notches is in a first plane, the bottom portion of at least another of the notches is in a second plane, and the upper surface is in a third plane. The first, second, and third planes are at least substantially parallel to one another and a distance between the first and third planes is different from a distance between the second and third planes.

In a further aspect, the creping blade includes a plurality of protrusions adjacent to the notches and extending from at least one of the first and second side faces. At least a portion of the plurality of the protrusions defines at least a part of the creping blade that contacts the outer surface of the rotatable cylinder. The protrusions are preferably formed from portions of the creping blade displaced when the plurality of notches are formed. More preferably, outer faces of the protrusions are dressed to an angle with respect to at least one of said first and second side faces approximately equal to a wear angle of the creping blade when the creping blade is positioned on the outer surface of the rotatable cylinder.

In another aspect, the invention includes a system for creping a cellulosic web. The system includes a rotatable cylinder and a creping blade similar to one of the creping blades described above. The creping blade is positioned with respect to the cylinder so that the creping blade is capable of creping cellulosic web from an outer surface of the cylinder when the web is on the outer surface and the cylinder is rotated.

In a further aspect, the system includes a pivot member coupled to the creping blade. The pivot member is configured to maintain the creping blade in contact with the outer surface of the cylinder when the creping blade becomes worn.

In yet another aspect, the invention includes an improvement to a method of manufacturing paper. The improvement includes creping a cellulosic web from an outer surface of a rotatable cylinder with a creping blade similar to one of the creping blades described above. The caliper and strength of the creped web is substantially constant when contact between the creping blade and the outer surface of the rotatable cylinder wears the creping blade.

In still another aspect, the invention includes paper having substantially constant caliper and strength produced by the improved method of manufacturing described above.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention and are incorporated in and constitute a part of this specification. The drawings illustrate embodiments of the invention and, together with the description, serve to explain the principles of the invention. In the drawings.

DETAILED DESCRIPTION OF PREFERRED EMBODIMENTS

Figure 1A:
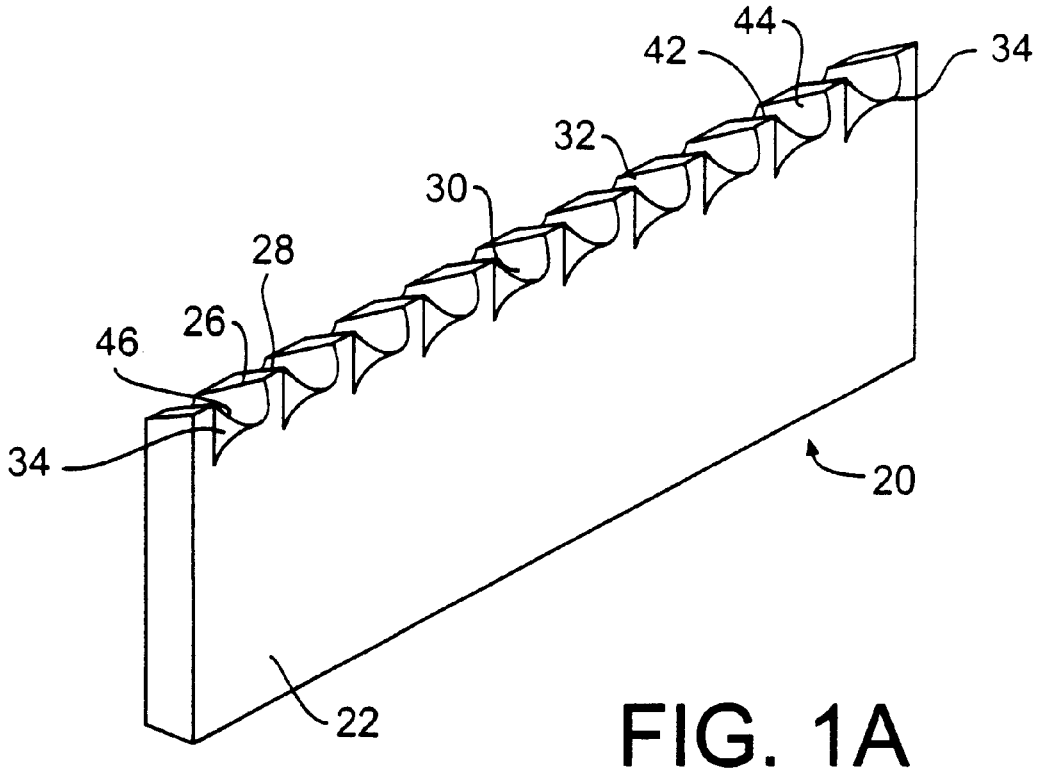
FIGS. 1A and 1B are perspective views of an embodiment of a creping blade.

Reference will now be made in detail to the present preferred embodiments of the invention, examples of which are illustrated in the accompanying drawings. Wherever possible, the same reference numbers are used in the drawings and the description to refer to the same or like parts, and the same reference numerals with alphabetical suffixes are used to refer to similar parts.

Figure 1B:
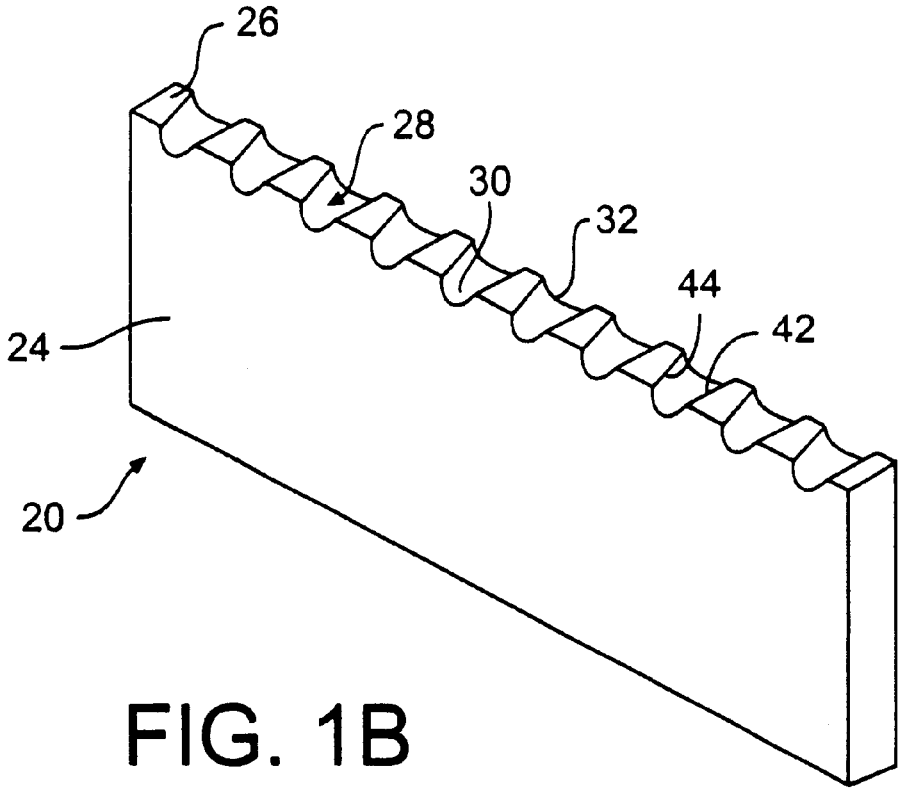
Figure 2:
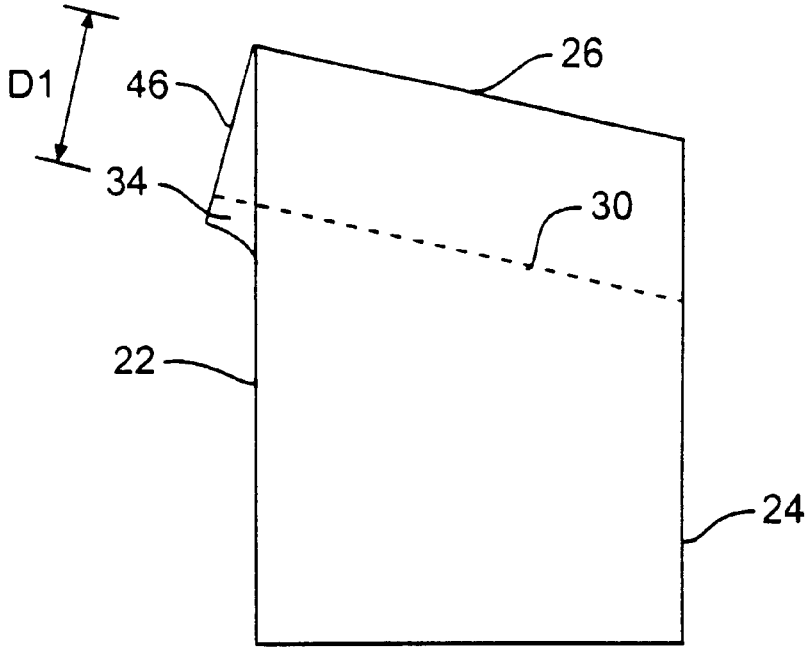
FIGS. 2 and 2A are side views of the creping blade of FIGS. 1A and 1B before and after wear from contact with a rotatable cylinder.

In accordance with the invention, there is provided a creping blade for creping a cellulosic web from a rotatable cylinder in a creping process. FIGS. 1A, 1B, and 2 show perspective views and a side view, respectively, of an embodiment of a creping blade having a first side face 22 and a second side face 24. The side faces 22, 24 are at least substantially opposite to one another. Preferably, the side faces 22, 24 are parallel to one another.

The blade 20 also includes an upper surface 26 that is not orthogonal with respect to at least one of the side faces 22, 24. The upper surface 26 is preferably substantially planar and beveled (i.e., not perpendicular) with respect to both of the side faces 22, 24. The upper surface 26 is preferably beveled at an angle from approximately 0° to approximately 35° with respect to a plane perpendicular to at least one of the first and second side faces 22, 24. More preferably, the upper surface 26 is beveled at an angle of from approximately 0° to approximately 25° with respect to a plane perpendicular to the side faces 22, 24. Although FIGS. 1A, 1B, and 2 show the upper surface 26 as being planar, one of ordinary skill in the art will recognize that the invention could still be practiced if the upper surface 26 is not planar. For example, the upper surface 26 could be paraboloid-shaped, hyperbolic-shaped, concave-shaped, and/or convex-shaped.

The blade 20 further includes a plurality of notches 28. Preferably, the notches 28 are evenly spaced along the upper surface 26. In a preferred embodiment, there are from approximately 6 notches per inch to approximately 40 notches per inch. In an alternate embodiment, the notches 28 are not uniformly spaced.

Each of the notches 28 has a bottom portion 30 and an open end 32, which both preferably extend between the side faces 22, 24. The bottom portion 30 is at least substantially parallel to the upper surface 26. Preferably, the upper surface 26 is planar and the bottom portions 30 of each of the notches 28 are at least substantially in a plane that is at least substantially parallel to the upper surface 26. That is, a perpendicular distance between the bottom portion 30 of each notch 28 and the upper surface 26 (i.e., the notch depth) is substantially the same for all of the notches. In a preferred embodiment, the notch depth is from approximately 0.010 inch to approximately 0.050 inch. In another embodiment, the notch depths are not the same for all of the notches.

The open ends 32 of the notches 28 are defined by at least a portion of the upper surface 26. The configuration of the notches 28 preferably increases the caliper of the cellulosic web when the creping blade 20 crepes the cellulosic web from an outer surface of a rotatable cylinder.

The notches 28 also include first and second side walls 42, 44 extending from the bottom portions 30 to the open ends 32. Preferably, the side walls 42, 44 are tapered from the open end to the bottom portion (i.e., the notches are more narrow near the bottom portions 30). See FIGS. 1A and 1B. In an alternative embodiment, the side walls 42, 44 are tapered from the bottom portion to the open end. In still another embodiment, the side walls are not tapered.

Figure 3:
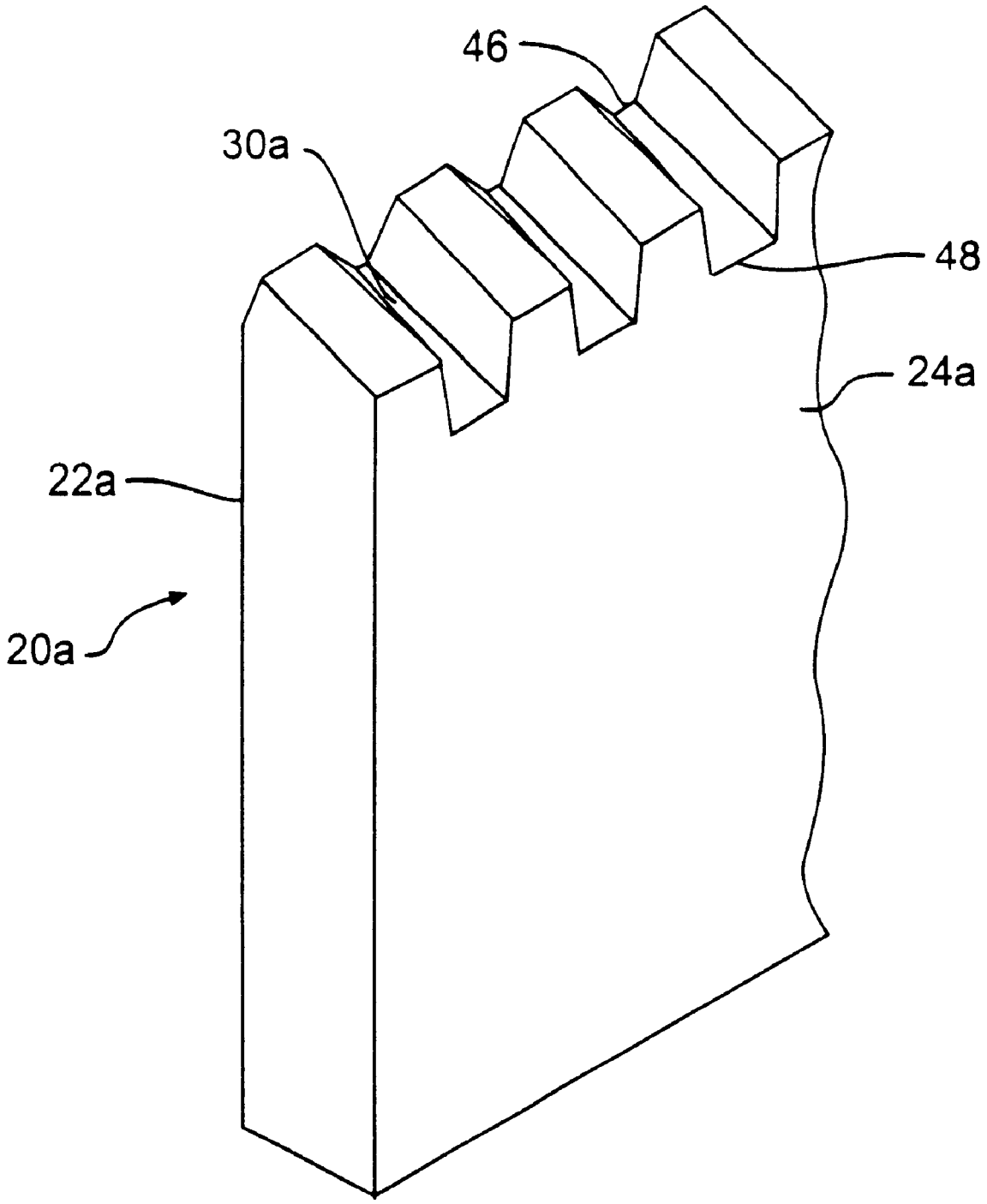
FIG. 3 is a partial perspective view of an alternate embodiment of a creping blade.
Figure 4A:
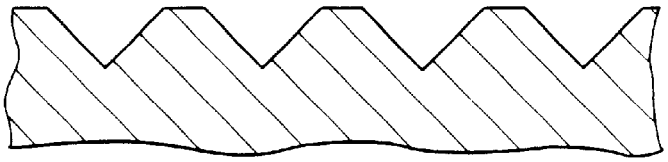
FIGS. 4A–4F are schematic views showing different notch cross-sections.
Figure 4B:
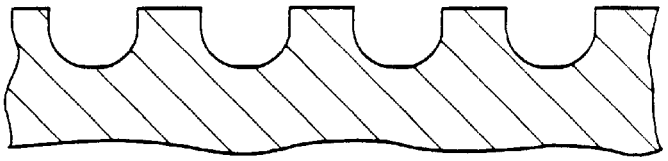
Figure 4C:
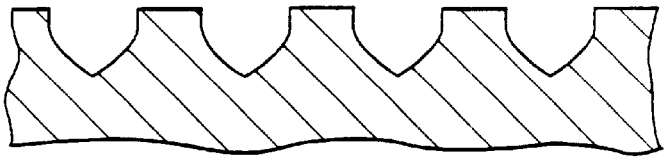
Figure 4D:
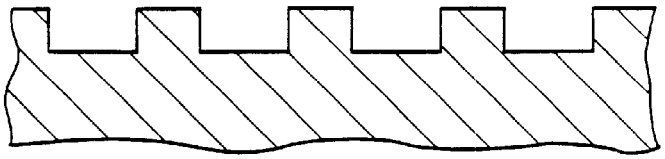
Figure 4E:
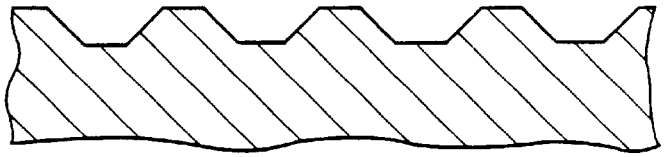
Figure 4F:
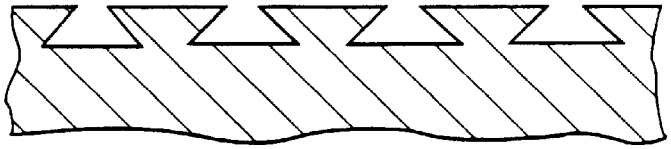

Since the notches 28 shown in FIGS. 1A and 1B have generally U-shaped crosssections, the bottom portions 30 of the notches 28 are substantially linear. However, the bottom portions could be a variety of other shapes, such as planar or paraboloid shaped. For example, FIG. 3 shows a blade 20*a* having a planar bottom portion 30*a*. The bottom portion 30*a* of the blade 20*a* is tapered from one end 48 adjacent to the first side 22*a* to another end 46 adjacent to the second side 24*a*. In an alternate embodiment, the bottom portion 30*a* is tapered from the end 46 to the end 48.

As shown in FIGS. 4A–4F, respectively, a cross section of each of the notches 28 in a plane parallel to at least one of the first and second side faces 22, 24 of the blade 20 is preferably one of substantially V-shaped, substantially U-shaped, substantially crescent-shaped, substantially rectangular-shaped, substantially truncate-V-shaped, and substantially dovetail-shaped. In an alternate embodiment, the blade includes notches with two or more different cross-sections.

Referring to FIGS. 1A and 2, the blade 20 preferably includes a plurality of protrusions 34 adjacent to the notches 28 and extending from the first side face 22. The protrusions 34 are preferably formed from portions of the creping blade 20 displaced when the plurality of notches 28 are formed in the blade 20.

Figure 5:
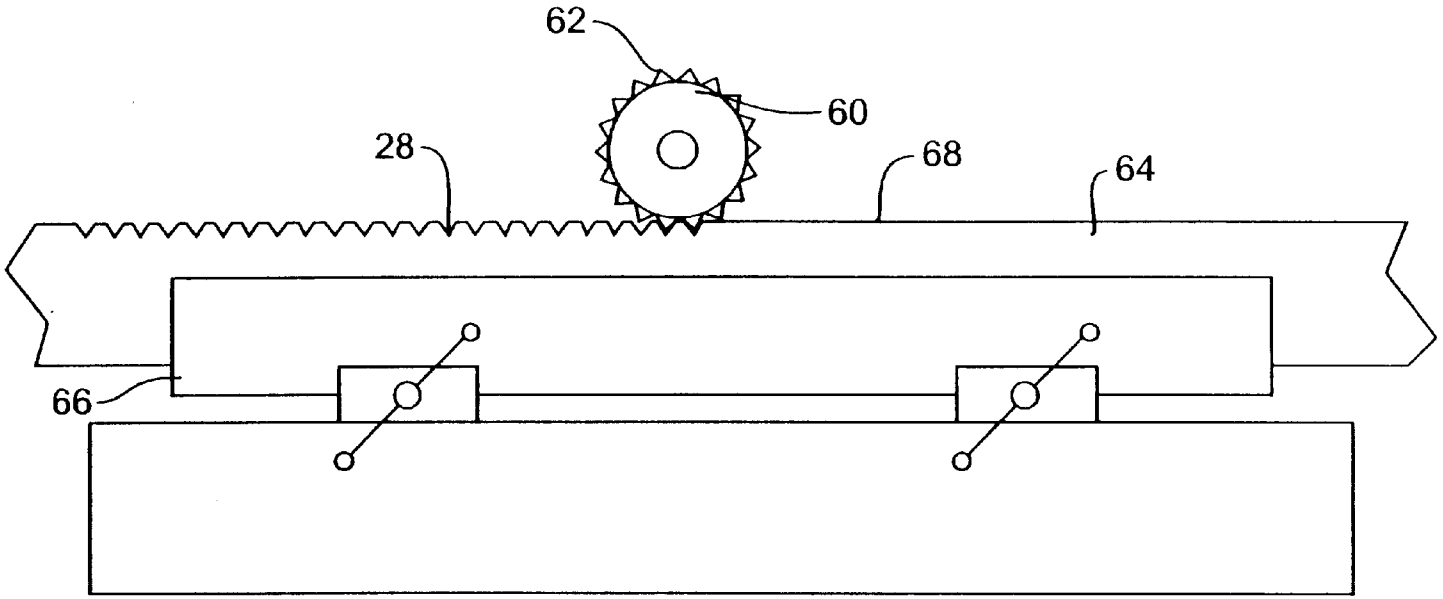
FIG. 5 is a schematic view of a step in an exemplary method of manufacturing notches in a creping blade.

FIG. 5 is a schematic view of a step in an exemplary method of manufacturing notches in a creping blade, similar to the blade 20. Preferably, the manufacturing begins by cutting a rectangular blank 64 of material to a desired length, width, and thickness. Then, a top surface 68 is beveled to a desired angle with respect to the side faces 22, 24. To form the notches 28, a knurling wheel 60 is pressed into the top surface 68 of the blank 64 so that teeth 62 of the knurling wheel 60 are substantially perpendicular to the top surface 68. As the teeth 62 deform the blank 64, material from the blank 64 will flow towards both of the side faces 22, 24, thereby forming protrusions of material. The protrusions extending from the side face 22 (i.e., the side face that opposes the rotatable cylinder) are preferably dressed (i.e., machined or filed) to a wear angle W (see FIG. 7), which is approximately equal to an angle of contact between the blade and the rotatable cylinder when the blade is positioned with respect to the rotatable cylinder. In a preferred embodiment, the protrusions extending from the side face 24 are dressed flush with the side face 24. The blank 64 is preferably held in position with a vice 66 relative to the knurling wheel 60. The notch formation method shown schematically in FIG. 5 is merely an example of a conventional method, and is not intended to limit the scope of the invention to a blade manufactured by the exact method described herein.

The creping blade 20 is preferably formed of hardened steel. However, the blade could be manufactured from other metallic and non-metallic materials.

Figure 6:
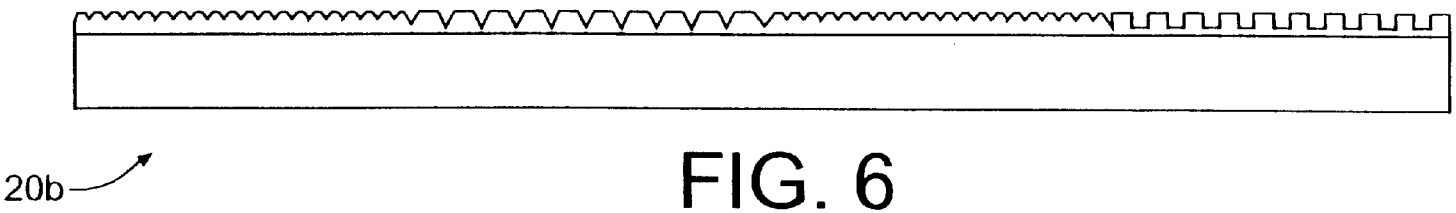
FIG. 6 is a partial schematic view of another embodiment of a creping blade having multiple notch depths, multiple notch frequencies, and multiple notch cross-sections.

In another embodiment, there is provided a creping blade having notches with at least one of multiple notch spacing frequencies, multiple notch depths, and multiple notch cross-sections. For example, FIG. 6 shows an embodiment of a creping blade 20*b* including multiple notch spacing frequencies, multiple notch depths, and multiple notch cross-sections.

Figure 7:
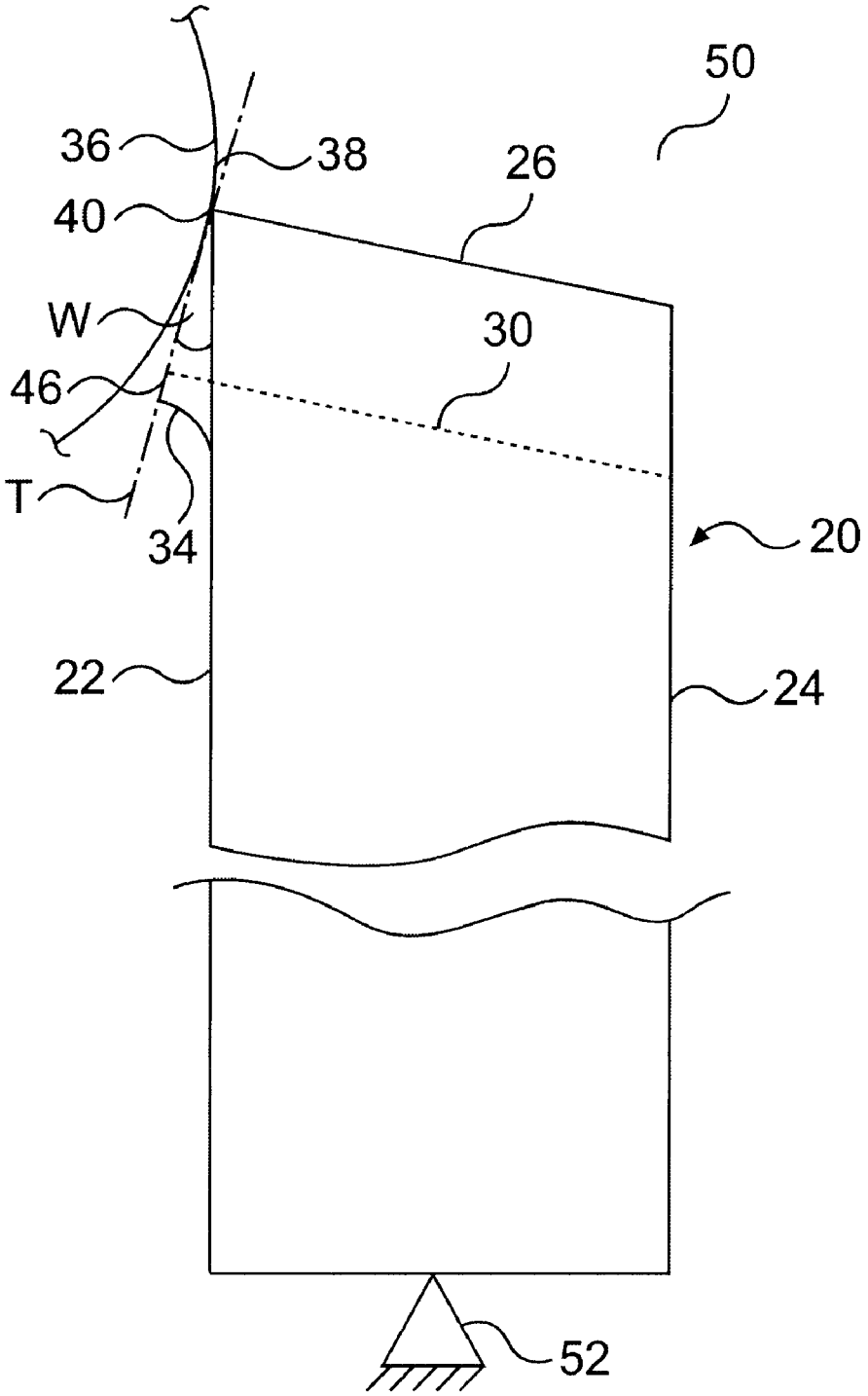
FIG. 7 is a schematic view of a system including the creping blade of FIGS. 1A, 1B, and 2 positioned with respect to a rotatable cylinder.

In another embodiment, a system for creping a cellulosic web is provided. FIG. 7 is a schematic view of a system 50 including a rotatable cylinder 36 and the creping blade 20 positioned with respect to the rotatable cylinder 36. The rotatable cylinder 36 is preferably a part of a dryer configured to heat an outer surface 38 of the cylinder 36. More preferably, the rotatable cylinder 36 is the drum of a Yankee dryer. Preferably, at least a portion of the protrusions 34 defines a part of the creping blade 20 that contacts an outer surface 38 of the rotatable cylinder 36. The protrusions 34 preferably facilitate complete contact between the blade 20 and the outer surface 38. As the rotatable cylinder 36 rotates with respect to the blade 20, the part of the blade 20 that contacts the outer surface 38 will wear down along a direction of a line T, tangent to the outer surface 38 at a point of contact 40 between the blade 20 and the outer surface 38. As mentioned above, the position of the blade 20 with respect to the cylinder 36 is referred to by an angle called the wear angle W. The wear angle W is an angle having a vertex at the contact point 40 and rays formed by a portion of the first side 22 of the blade 20 and a portion of the line T.

In a preferred embodiment, outer faces 46 of the protrusions 34 are dressed (i.e., machined or filed) so that an angle between the outer faces 46 and the first side surface 22 is substantially equal to the wear angle. Dressing the outer faces 46 to the wear angle facilitates contact between the blade 20 and the outer surface 38 of the rotatable cylinder 36 along substantially the entire length of the blade 20. Preferably, the wear angle is from approximately 5° to approximately 25°. More preferably, the wear angle is from approximately 9° to approximately 18°. In an alternate embodiment, the protrusions 34 are dressed to an angle other than the wear angle.

Figure 8B:
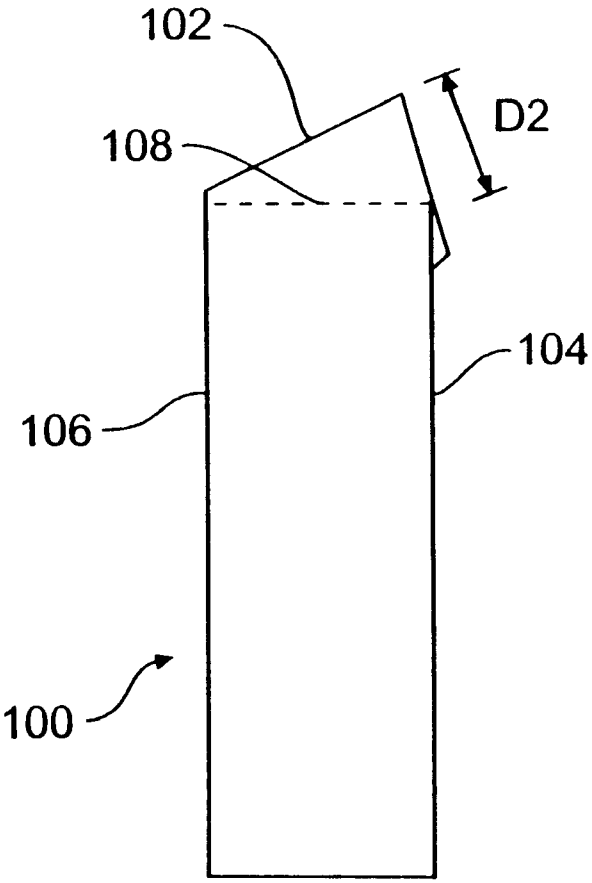
FIG. 8B PRIOR ART
FIGS. 8A and 8B are side views of a prior art creping blade before and after wear from contact with a rotatable cylinder.
Figure 8A:
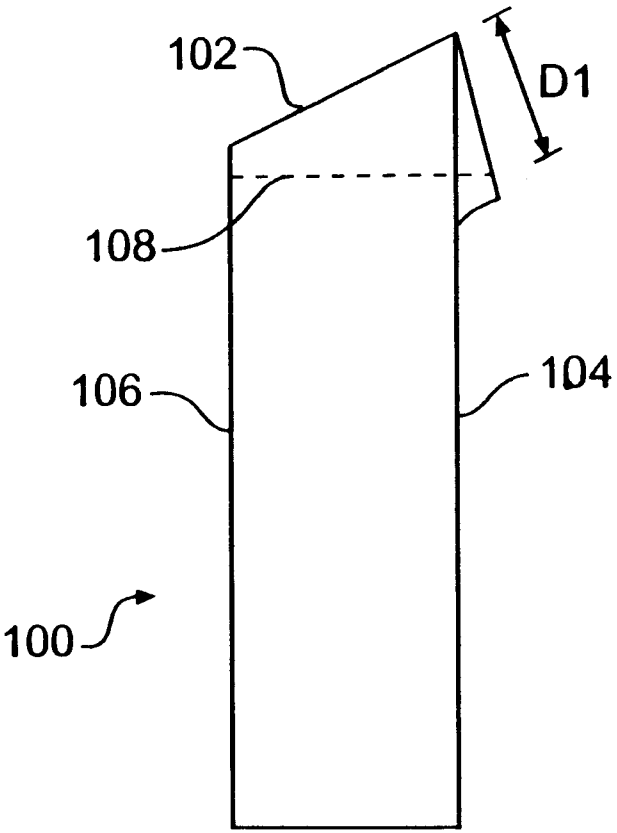
FIG. 8A PRIOR ART

FIGS. 8A and 8B are side views of a creping blade 100, similar to the creping blade disclosed in the '134 patent, before and after wear from contact between the blade 100 and a rotatable cylinder, respectively. The blade 100 includes a beveled surface 102 beveled with respect to side faces 104, 106 and serrulations formed in the blade adjacent to the beveled surface 102. The serrulations are configured so that a bottom 108 of each serrulation is perpendicular to the side faces 104, 106, rather than being substantially parallel to the beveled surface 102.

Because of the configuration of the serrulations of the blade 100, the effective depth of the serrulations decreases with time. For example, a distance D1 (see FIG. 8A) is the effective serrulation depth of a new blade configured like the '134 blade. However, as the blade 100 wears, the effective serrulation depth will decrease to a distance D2 (see FIG. 8B). Paper produced by the blade 100 when the effective serrulation depth is D1 will have a caliper and strength different from that of paper produced when the effective serrulation depth is D2.

Figure 2A:
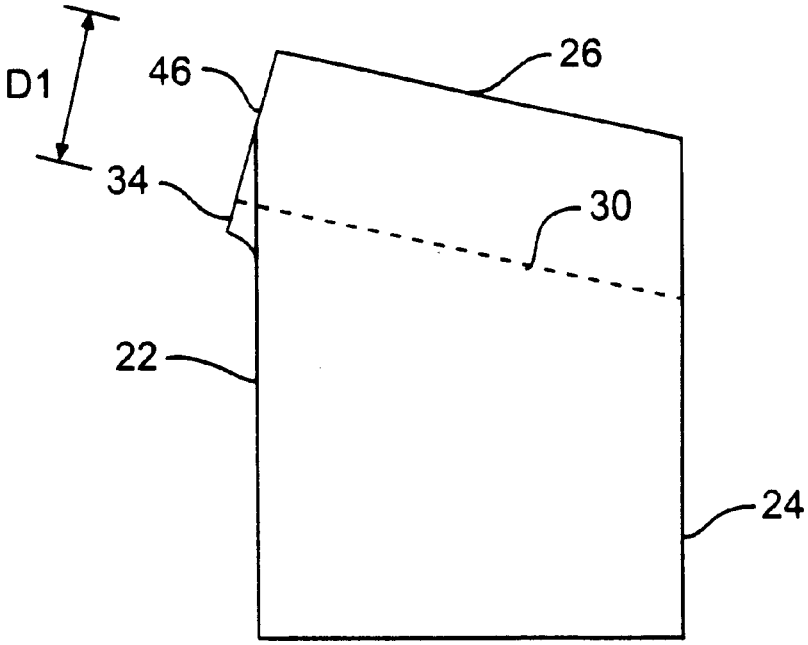

Unlike the blade 100 of FIGS. 8A and 8B, the blade 20 of FIGS. 1A, 1B, 2, and 7, and the blade 20*a* of FIG. 3 of the present invention have an effective notch depth that is substantially unaffected by wear of the blade. In particular, since the bottom portions of the notches 28 are at least substantially parallel to the upper surface 32, the distance between the bottom portion 30 and the upper surface 32 (i.e., the effective notch depth) remains substantially constant as the blade 20 wears from contact with the outer surface 38 of the rotatable cylinder 36 when the cylinder 36 rotates and the blade 20 crepes cellulosic web from the outer surface 38. (Compare FIGS. 2 and 2A each having notch depth D1.) Thus, the caliper and strength of cellulosic web creped with the blade 20 is substantially unaffected by wear of the blade 20.

Figure 9:
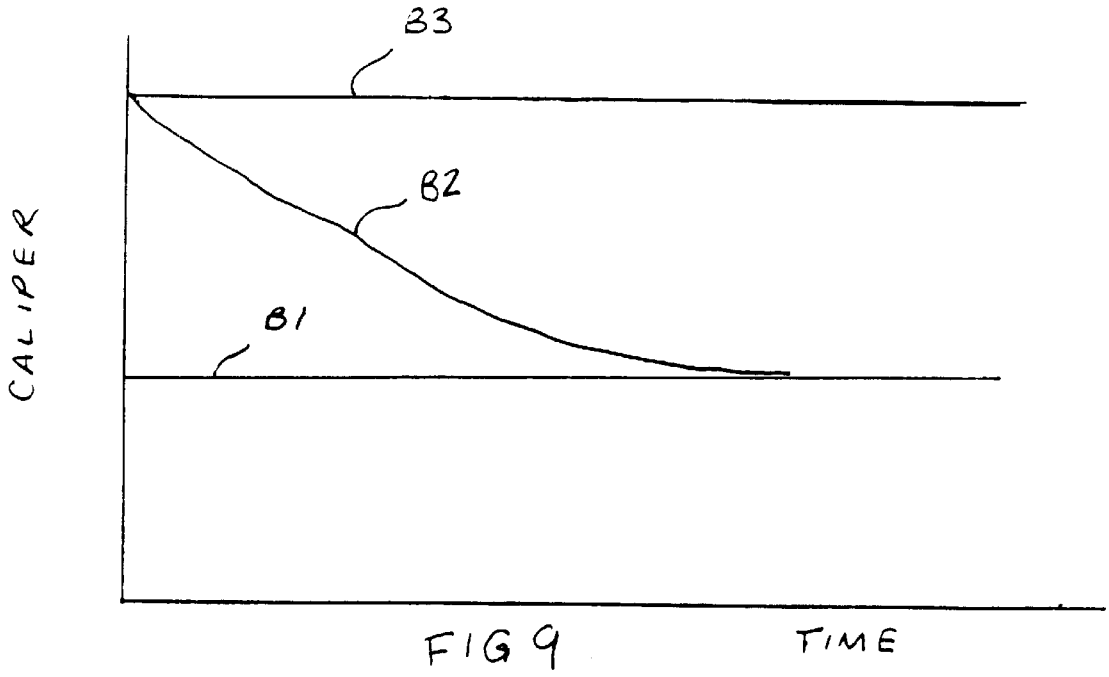
FIG. 9 is a graph of paper caliper versus blade wear.
Figure 10:
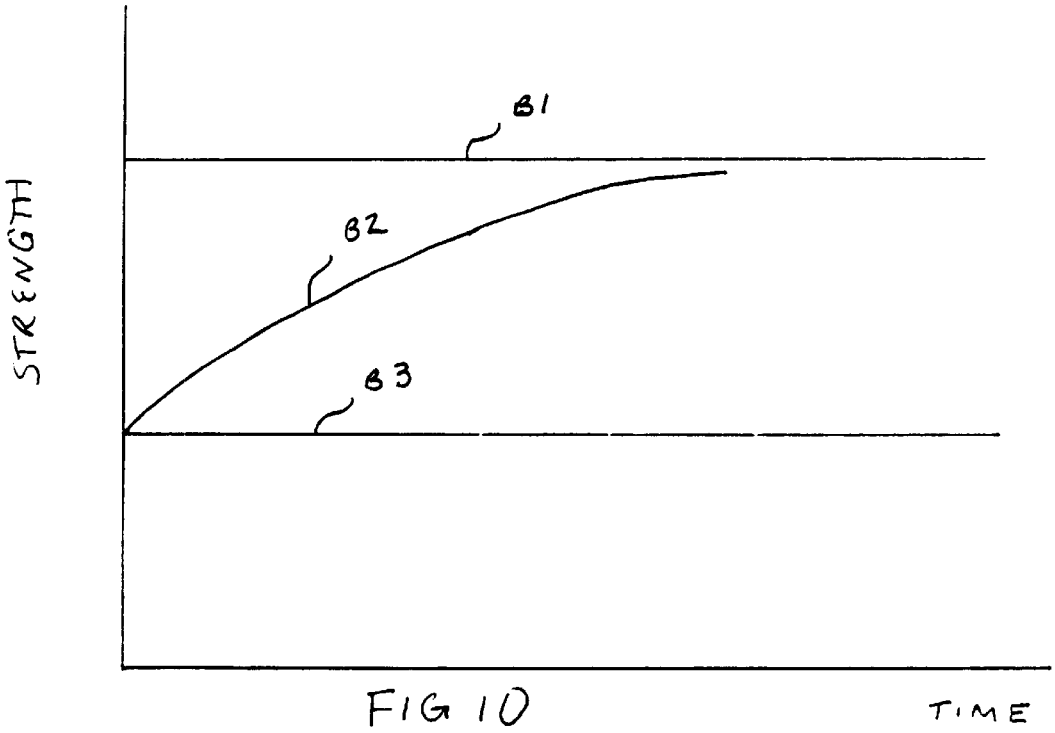
FIG. 10 is a graph of paper strength versus blade wear.
Figure 14:
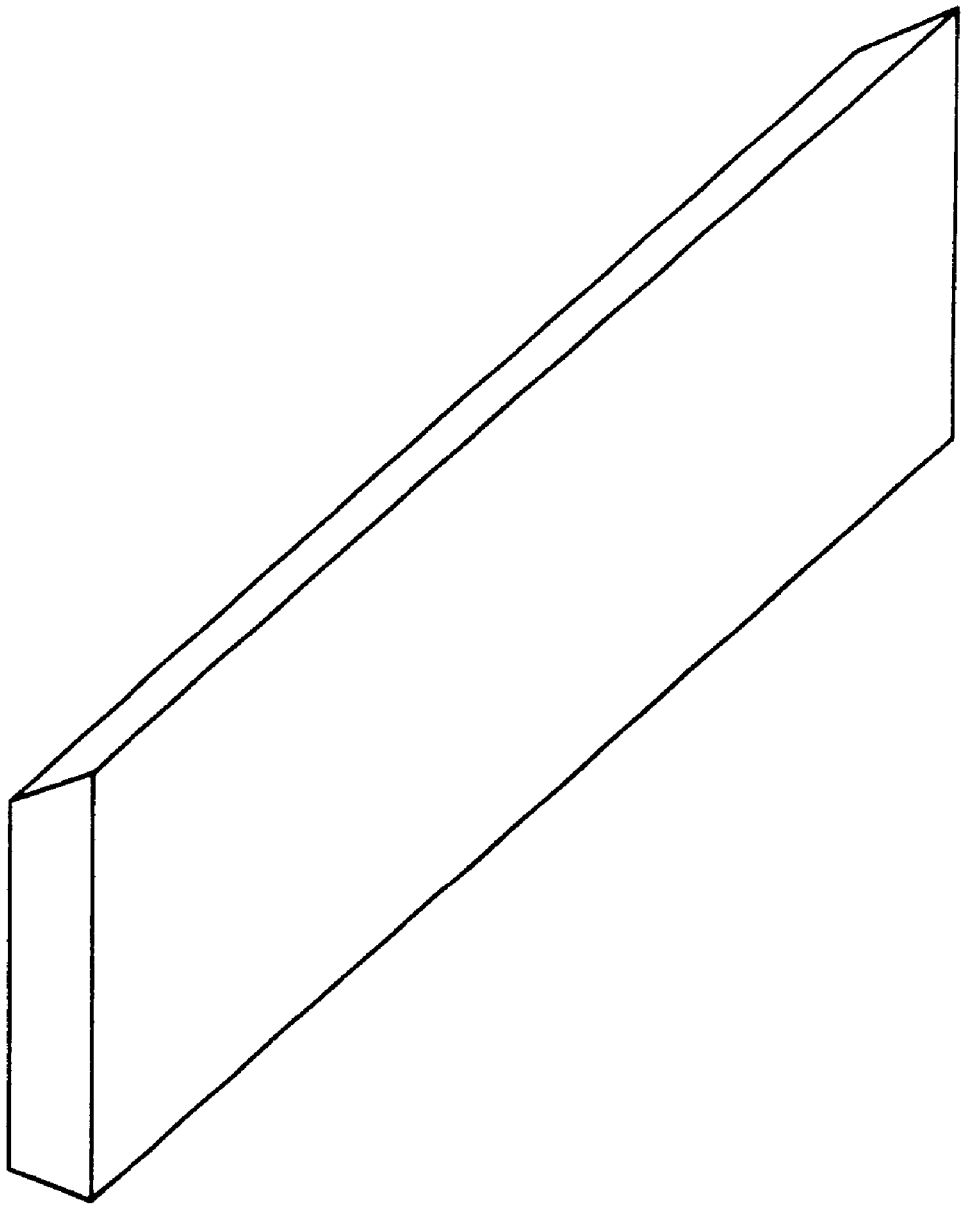
FIG. 14 PRIOR ART
FIG. 14 is a perspective view of a prior art creping blade.

FIGS. 9 and 10 are graphs illustrating estimates of paper caliper and strength curves over time (i.e., paper caliper and strength versus blade wear), respectively, for a conventional blade (labeled "B1" and shown in FIG. 14), a blade similar to the '134 blade (labeled "B2" and shown in FIGS. 8A and 8B), and a blade according to the present invention (labeled "B3"). The blades B1 and B3 both produce paper having substantially constant caliper and strength, however, the B3 blade (i.e., the creping blade of the present invention) produces paper that is thicker and softer than the B1 blade. In particular, the B3 blade can increase the caliper of paper from about 20% to about 70% more than conventional blades, while having a strength that is from about 15% to about 25% less strong (i.e., softer) than paper produced by conventional blades. The blade B2 (i.e., the '134 blade), although initially producing paper having caliper and softness larger than the conventional blade B1, produces paper having reduced caliper and increased strength as the B2 blade wears.

Referring to FIG. 7, in a preferred embodiment, the system 50 further includes a pivot member 52 (shown schematically) coupled to the creping blade 20. The pivot member 52 is configured to maintain the blade 20 in contact with the outer surface 38 of the cylinder 36 as the blade 20 becomes worn.

Figure 11:
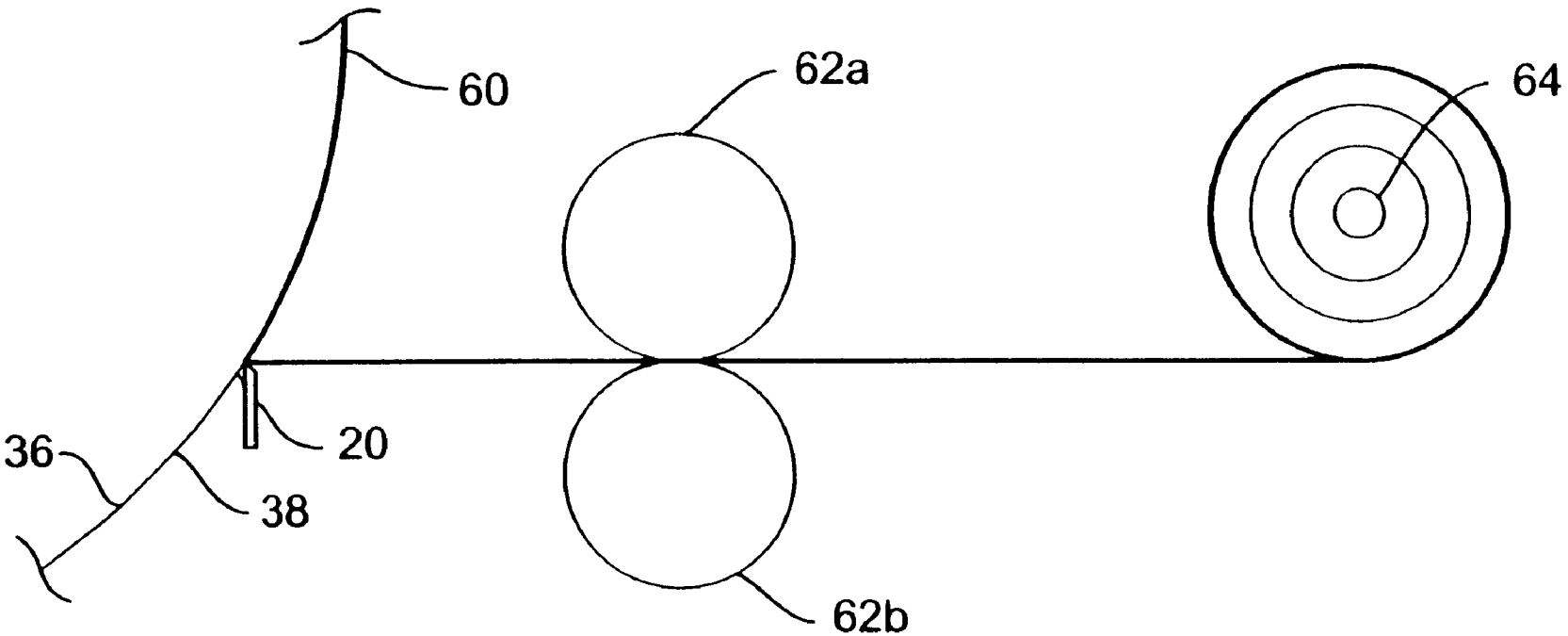
FIG. 11 is a schematic view of a dry creping process.

In another embodiment, there is provided an improvement in a method of manufacturing paper. FIG. 11 is a schematic view of a dry creping process, wherein a cellulosic web 60 is creped from the outer surface 38 of the rotatable cylinder 36 with the creping blade 20 to form paper having caliper and strength substantially constant when contact between the creping blade 20 and the outer surface 38 wears the creping blade 20. In the dry creping process, the cellulosic web 60 preferably has a moisture content of from about 30% to about 70% by weight when it is initially positioned on the outer surface 38 of the cylinder 36 and a moisture content of from about 2% to about 15% by weight when the cellulosic web 60 contacts the creping blade 20. After dry creping, the cellulosic web 60 is optionally passed through calender rolls 62*a*, 62*b* to impart smoothness and reduce thickness of the cellulosic web 60. Thereafter, the cellulosic web 60 is wound onto a reel 64.

Figure 12:
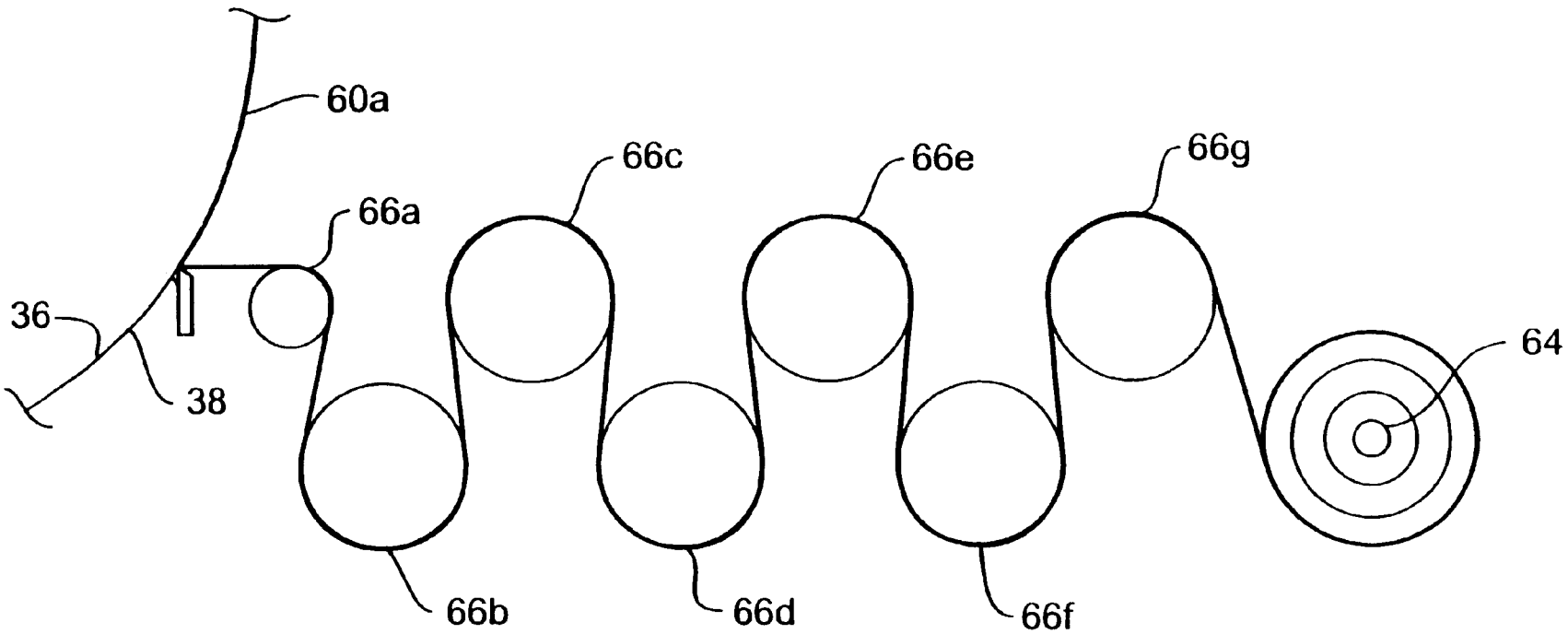
FIG. 12 is a schematic view of a wet creping process.

FIG. 12 is a schematic view of a wet creping process. In wet creping, similar to dry creping, a cellulosic web 60*a* is positioned on the outer surface 38 of the rotatable cylinder 36 and is creped from the outer surface 38 with the creping blade 20. However, in wet creping, the cellulosic web 60*a* has a moisture content of from about 30% to about 70% by weight when the web 60*a* is initially positioned on the outer surface 38, and a moisture content of from about 15% to about 60% when the web 60*a* is creped from the outer surface 38. After wet creping, the web 60*a* is passed over one or more dryers 66*a–g* (i.e., can dryers or even through-air dryers) and then wound onto the reel 64.

In addition to dry creping and wet creping, the creping blade of the present invention could be used in a through-air-drying process or a re-crepe process. These processes are described in the '134 patent.

Figure 13:
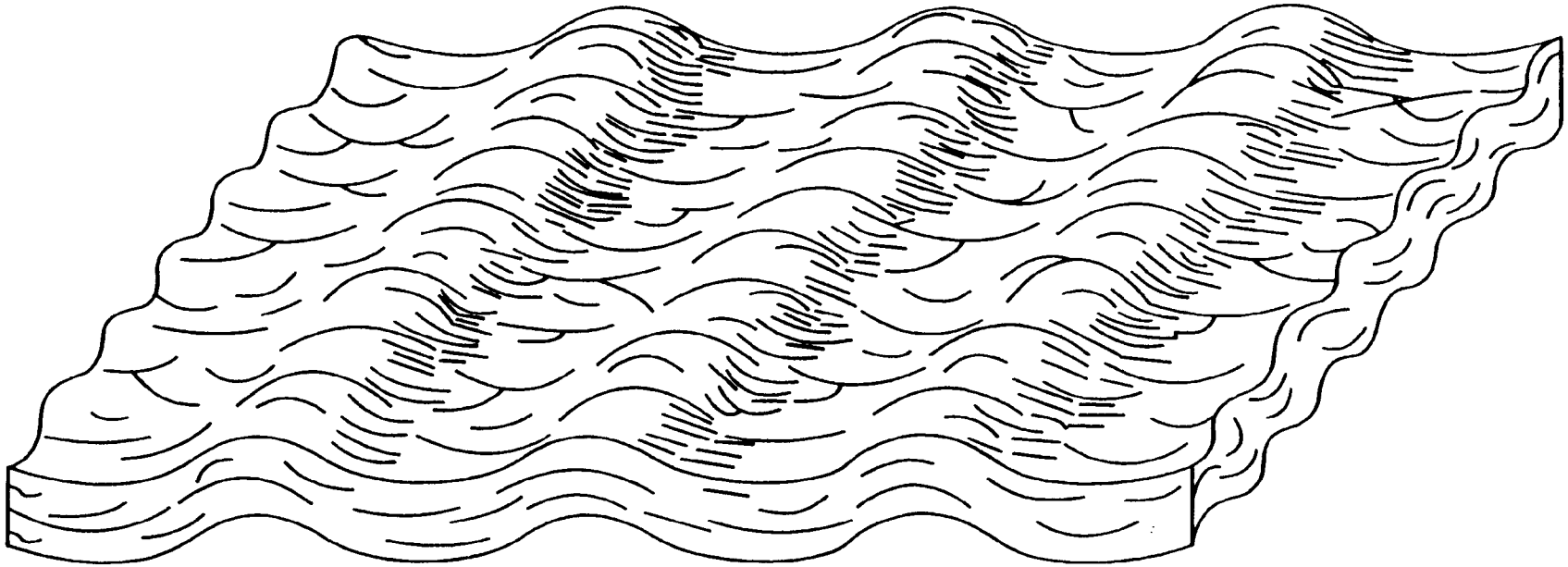
FIG. 13 is a view of creped paper.

In yet another embodiment, there is provided paper having substantially constant caliper and strength as the creping blade wears. FIG. 13 is a view of paper produced by a process using the creping blade according to the present invention. Preferably, the paper is absorbent, for example, a towel and/or a tissue. In a preferred embodiment, the paper includes recycled material, such as ash.

It will be apparent to those skilled in the art that various modifications and variations can be made to the structure and methodology of the present invention without departing from the spirit or scope of the invention. In view of the foregoing, it is intended that the present invention cover modifications and variations of the present invention, provided they fall within the scope of the following claims and their equivalents.

What is claimed is:

1. A creping blade for creping a cellulosic web from a rotatable cylinder in a creping process, the creping blade comprising:

first and second side faces, said first side face being at least substantially opposite to said second side face;

an upper surface not orthogonal to at least one of said first and second side faces; and a plurality of notches, each of the notches having a bottom portion and an open end, the bottom portion being at least substantially parallel to the upper surface and the open end being defined by at least a portion of the upper surface, the notches being configured to increase the caliper of the cellulosic web when the creping blade crepes the cellulosic web from an outer surface of the rotatable cylinder.

2. The creping blade of claim 1, wherein the upper surface is planar.

3. The creping blade of claim 2, wherein the notches are configured so that the bottom portion of each of the notches is at least substantially in a plane, said plane being at least substantially parallel to the upper surface.

4. The creping blade of claim 3, wherein said plane is spaced from the upper surface by a distance of from approximately 0.010 inch to approximately 0.050 inch.

5. The creping blade of claim 2, wherein the bottom portion of at least one of the notches is in a first plane, the bottom of at least another of the notches is in a second plane, and the upper surface is in a third plane, the first, second, and third planes being at least substantially parallel to one another and a distance between the first and third planes being different from a distance between the second and third planes.

6. The creping blade of claim 5, wherein the spacing of the notches along the blade is not uniform.

7. The creping blade of claim 6, wherein at least one of the notches has a cross-section different from another of the notches, in a plane parallel to at least one of said first and second side faces of the creping blade.

8. The creping blade of claim 2, wherein the upper surface is beveled with respect to at least one of said first and second side faces at an angle from approximately 0° to approximately 35° with respect to a plane perpendicular to at least one of said first and second side faces.

9. The creping blade of claim 8, wherein the upper surface is beveled at an angle of approximately 10° to approximately 25° with respect to a plane perpendicular to at least one of said first and second side faces.

10. The creping blade of claim 1, wherein an effective notch depth of each notch is defined by the distance between the bottom portion and the open end in a direction along a wear angle of the creping blade, the effective notch depth remaining substantially constant when contact between the creping blade and the rotatable cylinder wears the creping blade, and wherein caliper and strength of the cellulosic web creped by the creping blade are substantially unaffected by wear of the creping blade.

11. The creping blade of claim 1, wherein the creping blade includes a plurality of protrusions adjacent to the notches and extending from at least one of said first and second side faces, and wherein at least a portion of the protrusions defines at least a part of the creping blade that contacts the outer surface of the rotatable cylinder.

12. The creping blade of claim 11, wherein the protrusions are formed from portions of the creping blade displaced when the plurality of notches are formed.

13. The creping blade of claim 11, wherein outer faces of the protrusions are dressed to an angle with respect to at least one of said first and second side faces approximately equal to a wear angle of the creping blade when the creping blade is positioned on the outer surface of the rotatable cylinder.

14. The creping blade of claim 13, wherein the wear angle is from approximately 5° to approximately 25°.

15. The creping blade of claim 14, wherein the wear angle is from approximately 9° to approximately 18°.

16. The creping blade of claim 1, wherein a cross-section of each of the notches in a plane parallel to at least one of said first and second side faces of the creping blade is one of substantially V-shaped, substantially U-shaped, substantially crescent-shaped, substantially rectangular-shaped, substantially truncate-V-shaped, and substantially dovetail-shaped.

17. The creping blade of claim 1, wherein each of the notches includes first and second side walls, said side walls extending from the bottom portion of the notch to the open end and being tapered between the open end and the bottom portion.

18. The creping blade of claim 1, wherein the bottom portion of each of the notches is substantially linear.

19. The creping blade of claim 1, wherein the bottom portion of each of the notches is planar.

20. The creping blade of claim 19, wherein the bottom portion of each of the notches is tapered between a first end of the bottom portion adjacent to said first side face and a second end of the bottom portion adjacent to said second side face.

21. The creping blade of claim 1, wherein the number of notches is from approximately 6 notches per inch to approximately 40 notches per inch.

22. The creping blade of 1, wherein at least one of the notches has a cross-section different from another of the notches, in a plane parallel to at least one of said first and second side faces of the creping blade.

23. The creping blade of claim 22, wherein the spacing of the notches along the blade is not uniform.

24. The creping blade of claim 1, wherein the spacing of the notches along the blade is not uniform.

25. A system for creping a cellulosic web, the system comprising:

a rotatable cylinder; and the creping blade of claim 1, the creping blade being positioned with respect to the cylinder so that the creping blade is capable of creping the cellulosic web from an outer surface of the cylinder when the web is on the outer surface and the cylinder is rotated.

26. The system of claim 25, further comprising a pivot member coupled to the creping blade, the pivot member being configured to maintain the creping blade in contact with the outer surface of the cylinder when the creping blade becomes worn.

27. The system of claim 25, wherein the rotatable cylinder is part of a dryer configured to heat the outer surface of the cylinder.

28. The system of claim 27, wherein the dryer is a Yankee dryer.

29. In a method of manufacturing paper, the improvement comprising:

creping a cellulosic web from an outer surface of a rotatable cylinder with the creping blade of claim 1, wherein caliper and strength of the creped web is substantially constant when contact between the creping blade and the outer surface of the rotatable cylinder wears the creping blade.

30. The improvement of claim 29, further comprising positioning a cellulosic web that includes from about 30% to about 70% moisture by weight on the outer surface of the rotatable cylinder, wherein the cellulosic web is wet creped from the outer surface of the rotatable cylinder when the cellulosic web includes from about 15% to about 60% moisture by weight.

31. The improvement of claim 29, further comprising positioning a cellulosic web that includes from about 30% to about 70% moisture by weight on the outer surface of the rotatable cylinder, wherein the cellulosic web is dry creped from the outer surface of the rotatable cylinder when the cellulosic web includes from about 2% to about 15% moisture by weight.

32. The improvement of claim 29, wherein the cellulosic web includes recycled material.

33. The improvement of claim 32, wherein the recycled material includes ash.

* * * * *

UNITED STATES PATENT AND TRADEMARK OFFICE

CERTIFICATE OF CORRECTION

PATENT NO. : 6,527,913 B1 
DATED : March 4, 2003
INVENTOR(S) : Douglas W. Johnson and Dale T. Gracyalny It is certified that error appears in the above-identified patent and that said Letters Patent is hereby corrected as shown below:

Column 11,
Line 11, before "1," insert -- claim --.

Signed and Sealed this

Thirteenth Day of May, 2003

JAMES E. ROGAN
*Director of the United States Patent and Trademark Office*